US008287655B2

(12) United States Patent
Stein et al.

(10) Patent No.: US 8,287,655 B2
(45) Date of Patent: Oct. 16, 2012

(54) METHOD FOR CLEANING DIRT AND DEBRIS FROM SURFACES

(75) Inventors: Thomas Stein, Velbert (DE); Achim Liffers, Velbert (DE)

(73) Assignee: Stein & Co. GmbH (DE)

( * ) Notice: Subject to any disclaimer, the term of this patent is extended or adjusted under 35 U.S.C. 154(b) by 139 days.

(21) Appl. No.: 12/655,751

(22) Filed: Jan. 6, 2010

(65) Prior Publication Data

US 2011/0162677 A1 Jul. 7, 2011

Related U.S. Application Data

(63) Continuation of application No. 11/198,894, filed on Aug. 5, 2005, now abandoned.

(51) Int. Cl.
*B08B 7/00* (2006.01)

(52) U.S. Cl. ..... 134/10; 134/6; 134/21; 134/42; 15/329; 15/331; 15/334; 15/335

(58) Field of Classification Search ..... 15/329, 15/331, 334, 335; 134/6, 10, 21, 42
See application file for complete search history.

(56) References Cited

U.S. PATENT DOCUMENTS

| | | | | |
|---|---|---|---|---|
| 3,126,570 | A | 3/1964 | Green | |
| 5,467,502 | A * | 11/1995 | Johnson et al. | 15/339 |
| 5,787,546 | A | 8/1998 | Bass et al. | |
| 6,085,382 | A | 7/2000 | Bobrosky et al. | |
| 6,108,861 | A | 8/2000 | Vystrcil et al. | |
| 6,175,988 | B1 | 1/2001 | White et al. | |
| 7,284,297 | B2 * | 10/2007 | Shanor et al. | 15/323 |
| 7,284,298 | B2 | 10/2007 | Stein | |
| 7,356,874 | B2 * | 4/2008 | Macleod et al. | 15/328 |
| 2004/0158952 | A1 | 8/2004 | Stein | |
| 2006/0070206 | A1 * | 4/2006 | Fischer et al. | 15/334 |
| 2007/0028413 | A1 * | 2/2007 | Fischer et al. | 15/334 |
| 2010/0095476 | A1 * | 4/2010 | Kim et al. | 15/347 |

* cited by examiner

*Primary Examiner* — Bibi Carrillo
(74) *Attorney, Agent, or Firm* — Nils H. Ljungman & Associates

(57) ABSTRACT

A method of cleaning dirt and debris from surfaces using a cleaning device, such as a vacuum cleaner. The cleaning device has a handle unit which is attached to the body of the cleaning device adjacent a filter compartment. The handle unit has a handle portion that is spaced from the filter compartment to allow a user to place his or her hand through the space and grasp the handle portion and thereby carry the cleaning device using only the handle unit. The handle unit can also be detached from the body of the cleaning device, and then later re-attached, via lockable mating connecting elements.

6 Claims, 8 Drawing Sheets

METHOD FOR CLEANING DIRT AND DEBRIS FROM SURFACES

BACKGROUND

1. Technical Field

The present application relates to a method for removing dirt and debris from surfaces.

2. Background Information

The present application relates to a cleaner with an upper handle in the form of a steering handle which is an extension of a housing and a floor attachment which is located in the vicinity of the floor, whereby the dirt is transported via a hose which is in the form of an ascending line into an upper portion of the housing to a dust separator unit and the hose can be detached.

Cleaners are generally designed for use with attachments or nozzles. For other cleaning tasks, either other cleaning attachments are connected to the cleaner body or a hand-held hose is used. Both solutions have the disadvantage that either the equipment is difficult to handle, or the process of converting the unit from one operation to another is complex and time-consuming, because the objective is to make possible a rapid change between the types of operation.

OBJECT OR OBJECTS

The object is to improve a system of the prior art, and while retaining the suitability for floor cleaning, to make the use of an integrated hand-held vacuuming hose immediately available, as well as an additional handle for the operation and for transport of the unit, which guarantees a filter that is located on the housing, to make possible low air flow speeds with a large exhaust area.

SUMMARY

The present application teaches that the housing in the form of a vacuum cleaner body has, in the central area, an approximately cylindrical configuration in the form of an independent element, which is sheathed by filter material in the form of an exhaust filter and the exhaust air can be fed into a jacket chamber that is formed between the housing and filter material for exhaust, and in an area facing the motor compartment, passages to the jacket chamber are realized, and an outboard receptacle element for the hand-held vacuuming hose is provided, whereby the receptacle element is connected to the housing with some distance left open in between, with the realization of a reach-through opening for the replacement of the filter material.

Consequently, the overall appearance of the unit is preserved while the ease of operation of the vacuum cleaner body is increased, and it is also possible to avoid any adverse effects on a surrounding exhaust filter that is located in the vicinity of the housing.

In one advantageous configuration, the receptacle element is realized essentially in the form of a shell, in the manner of a curved receptacle.

When the receptacle element is realized in the shape of a shell, it is possible to realize at least the lower portion of the receptacle element in a tubular shape.

Alternatively, the present application teaches that the receptacle element can be realized in the manner of a curved receptacle, and is connected detachably to form a hand-held vacuuming element that can be removed from the body of the vacuum cleaner.

The present application also teaches that the receptacle element is detachably connected with the vacuum cleaner body in the connecting areas by means of lockable mating connecting elements.

The present application relates to a vacuum cleaner for removing dirt and debris from different surfaces and a method of operating a vacuum cleaner.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Exemplary embodiments of the embodiments are illustrated schematically in the accompanying drawings, in which.

DESCRIPTION OF EMBODIMENT OR EMBODIMENTS

Figure 1:
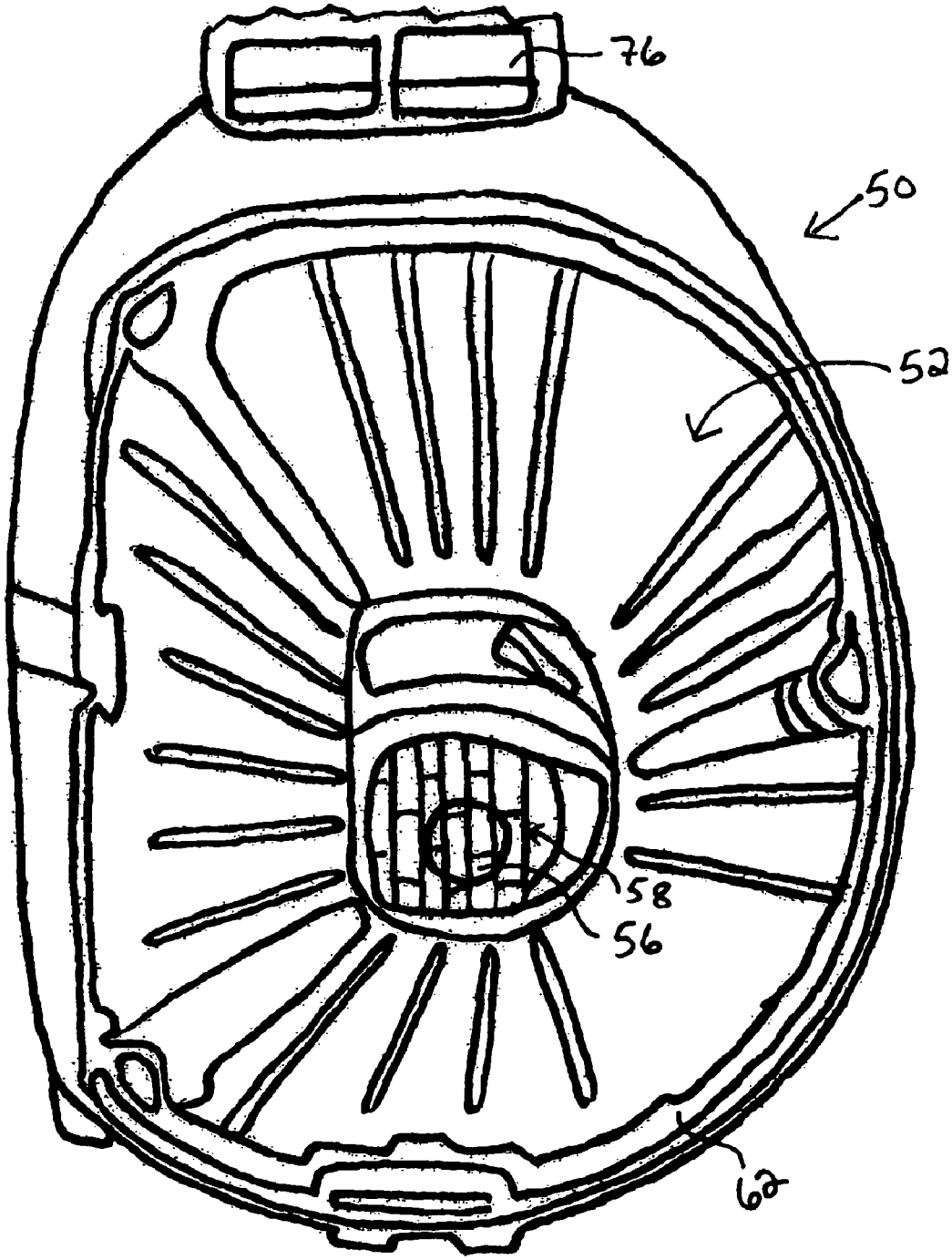
FIG. 1 shows an overhead view of the inside of a possible embodiment of a vacuum cleaner body.
Figure 2:
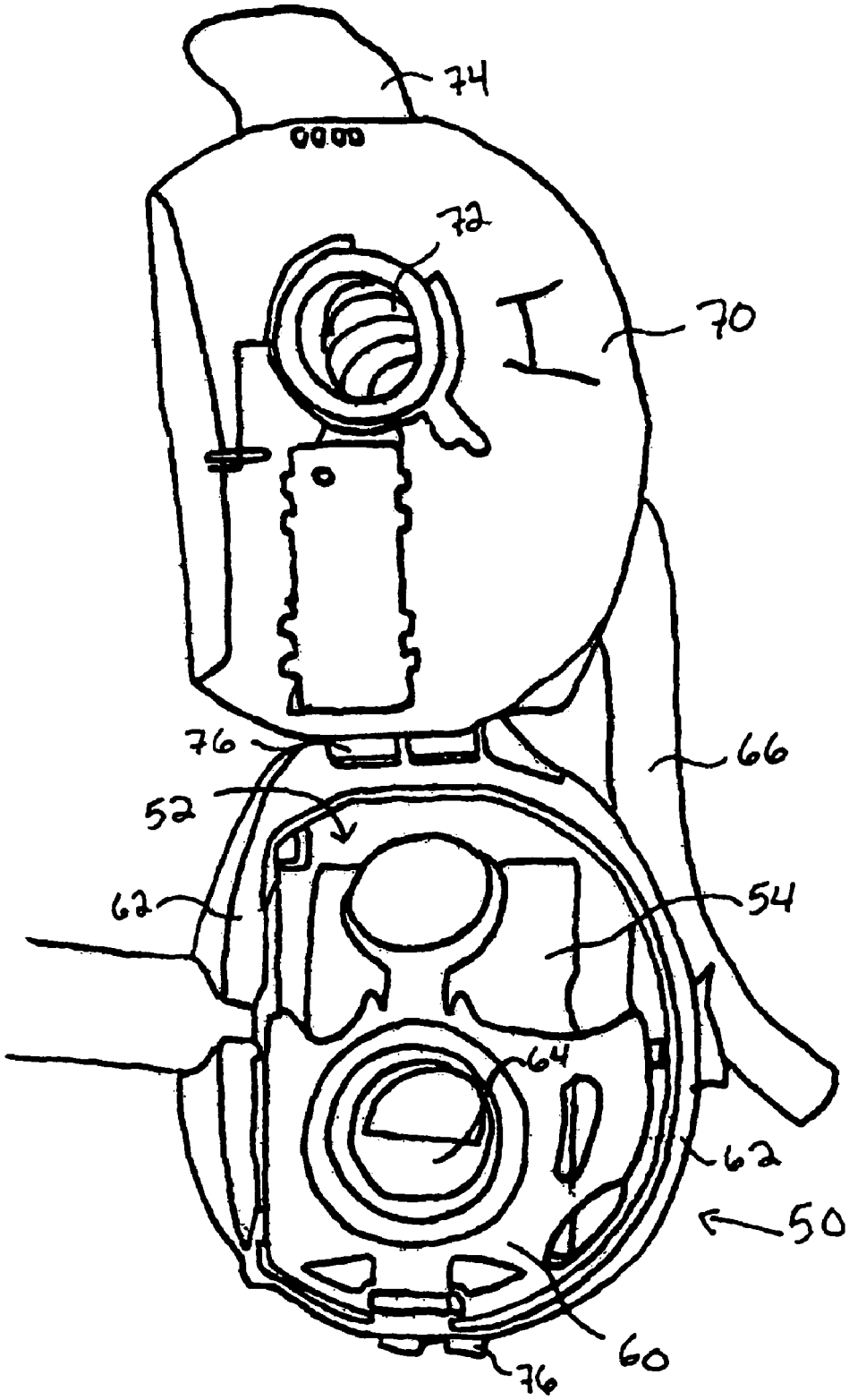
FIG. 2 shows an overhead view of a possible embodiment of a vacuum cleaner body with a bag installed therein.

FIG. 1 shows an overhead view of the inside of a possible embodiment of a vacuum cleaner body. In this possible embodiment, the vacuum cleaner body 50 comprises a filter bag compartment 52 for holding a filter bag 54 (as shown in FIG. 2) and a top rim 62 disposed about the top of the dust collection compartment 52. When installed, the filter bag 54 is disposed over an air exit hole 56, which air exit hole 56 allows air to flow from the filter bag compartment 52, down to the motor 8 and the motor compartment 9. The air then exits the motor compartment 9 in the manner described herein above. The filter bag 54 sits above a motor protection filter 58, which motor protection filter 58 is disposed between the air exit hole 56 and the filter bag compartment 52, preventing the filter bag 54 or any loose debris from blocking the air exit hole 56.

FIG. 2 shows an overhead view of a possible embodiment of a vacuum cleaner body 50 with a filter bag 54 installed therein. The filter bag 54 comprises an upper connecting portion 60 being configured to connect the filter bag 54 to the top rim 62 of the filter bag compartment 52. The upper connecting portion 60 could be constructed with a semi-hard material such as plastic or rubber. The upper connecting portion 60 comprises an opening 64, which opening 64 is configured and disposed to permit the flow of air from the hose 66 into the filter bag compartment 52.

The opening top portion 70 is connected to the top rim 62 of the vacuum cleaner body 50 with a hinge 76, allowing the top portion 70 to be opened and closed to change the filter bag 54. The opening top portion 70 comprises a hole 72 to connect the hose 66 to the vacuum cleaner body 50. The top portion 70 further comprises a tab 74 that connects with connecting tabs 76 on the vacuum cleaner body 50 for holding the top portion 70 shut once a filter is installed. Air and debris from the hose 66 flows downward through the hole 72 and the opening 64, into the filter bag 54. Debris is trapped inside the filter bag 54, while air continues to flow downward into the motor compartment. Air is then routed from the motor compartment upwards through air passages and into the jacket space formed by the filter material and the vacuum cleaner body, where it exits through the filter material around the periphery of the vacuum cleaner body 50.

Figure 3:
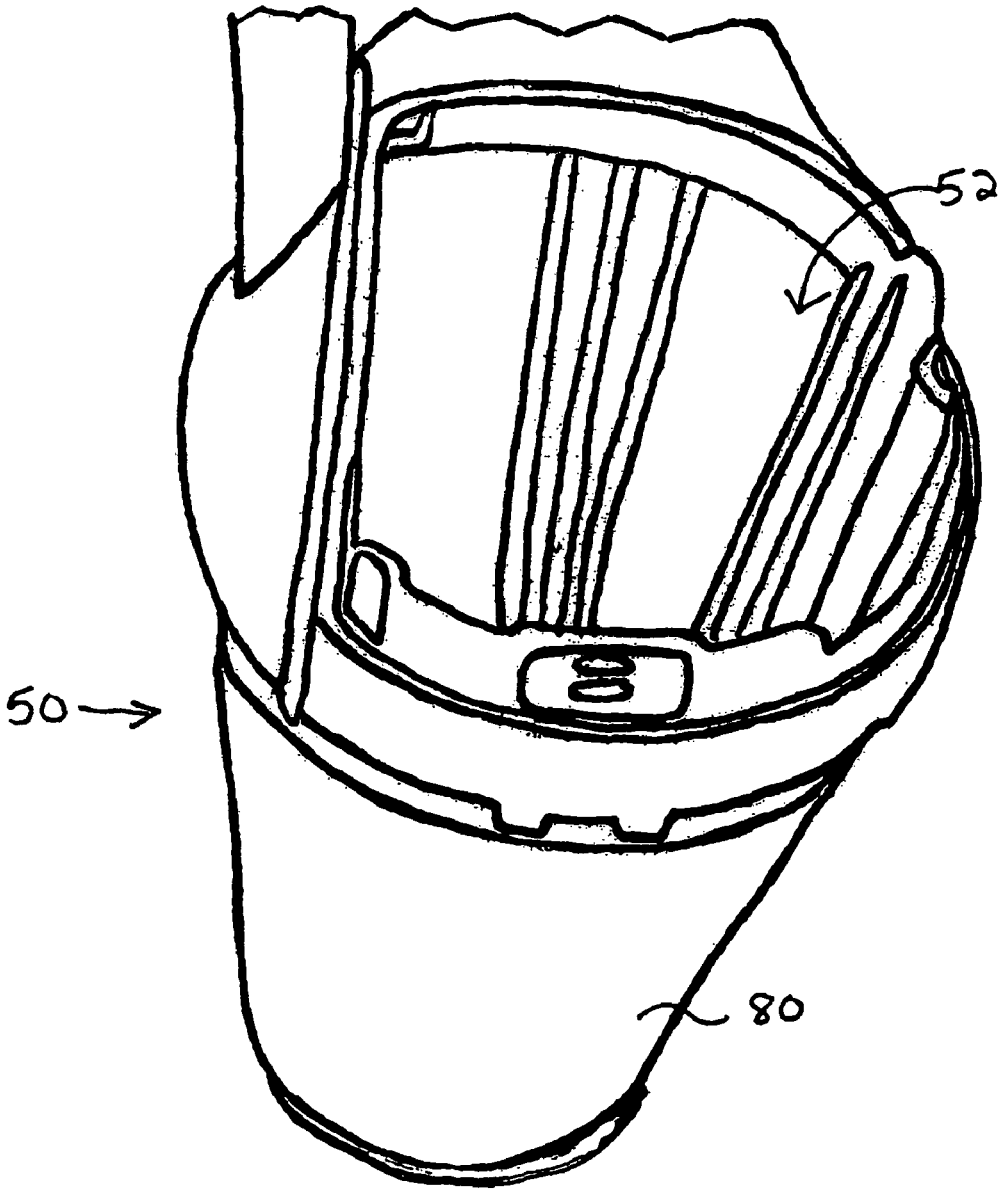
FIG. 3 shows a perspective view of a possible embodiment of a vacuum cleaner body.

FIG. 3 shows a perspective view of a possible embodiment of a vacuum cleaner body with the top portion 70 removed, exposing the filter bag compartment 52. The filter material 80 is disposed about the periphery of the vacuum cleaner body 50.

Figure 5:
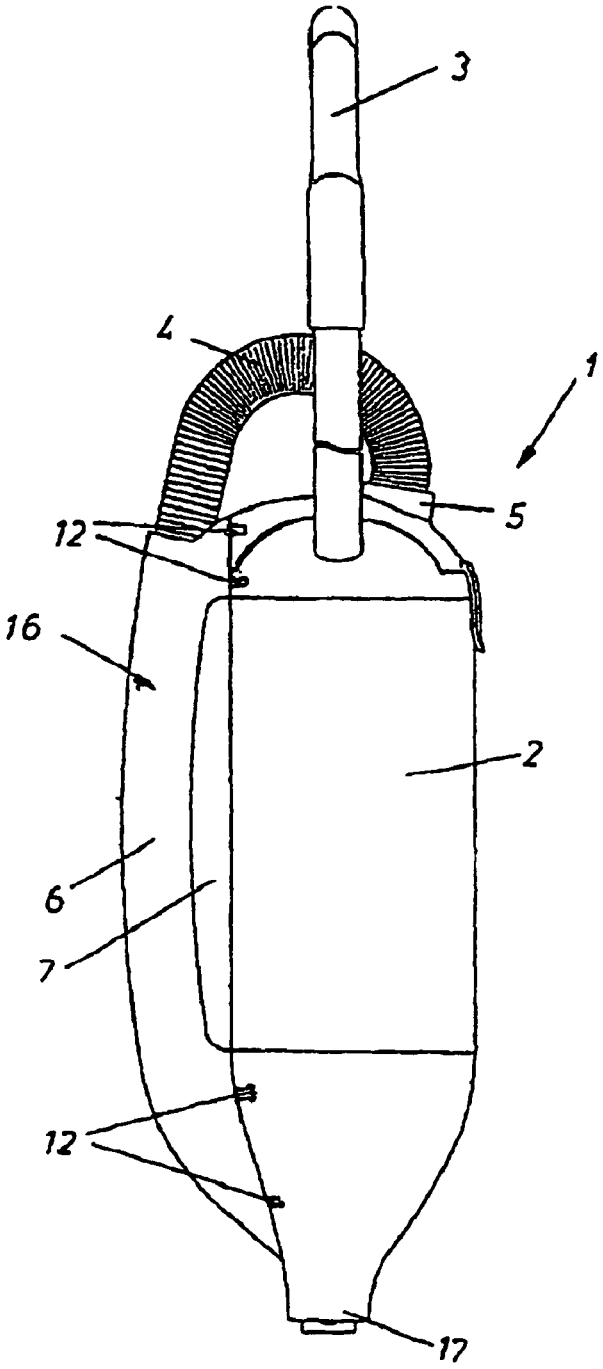
FIG. 5 is a head-on view of a vacuum cleaner with a receptacle element in the form of a tubular configuration.
Figure 6:
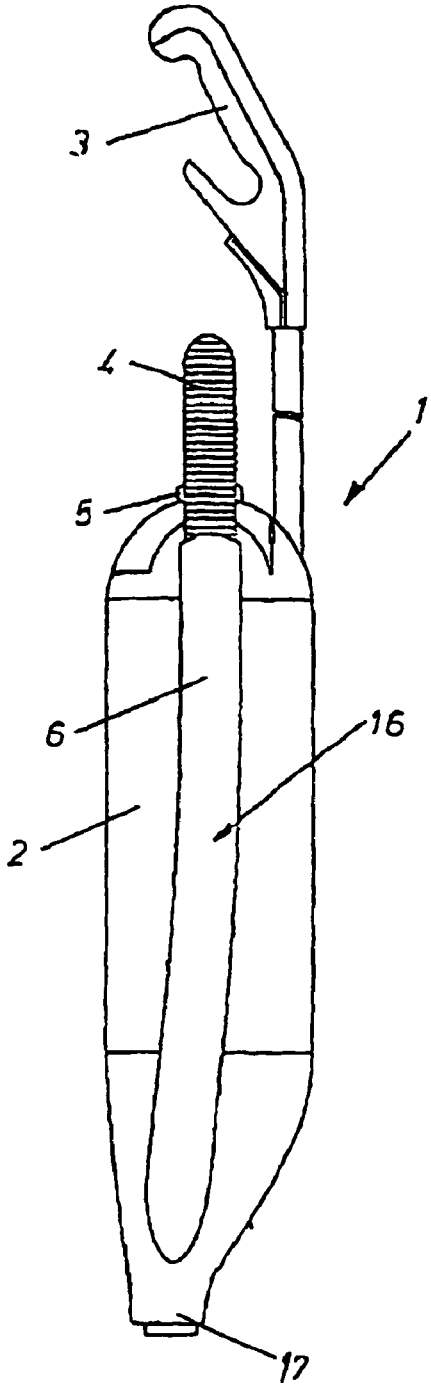
FIG. 6 is a side view of the vacuum cleaner illustrated in FIG. 5.
Figure 9:
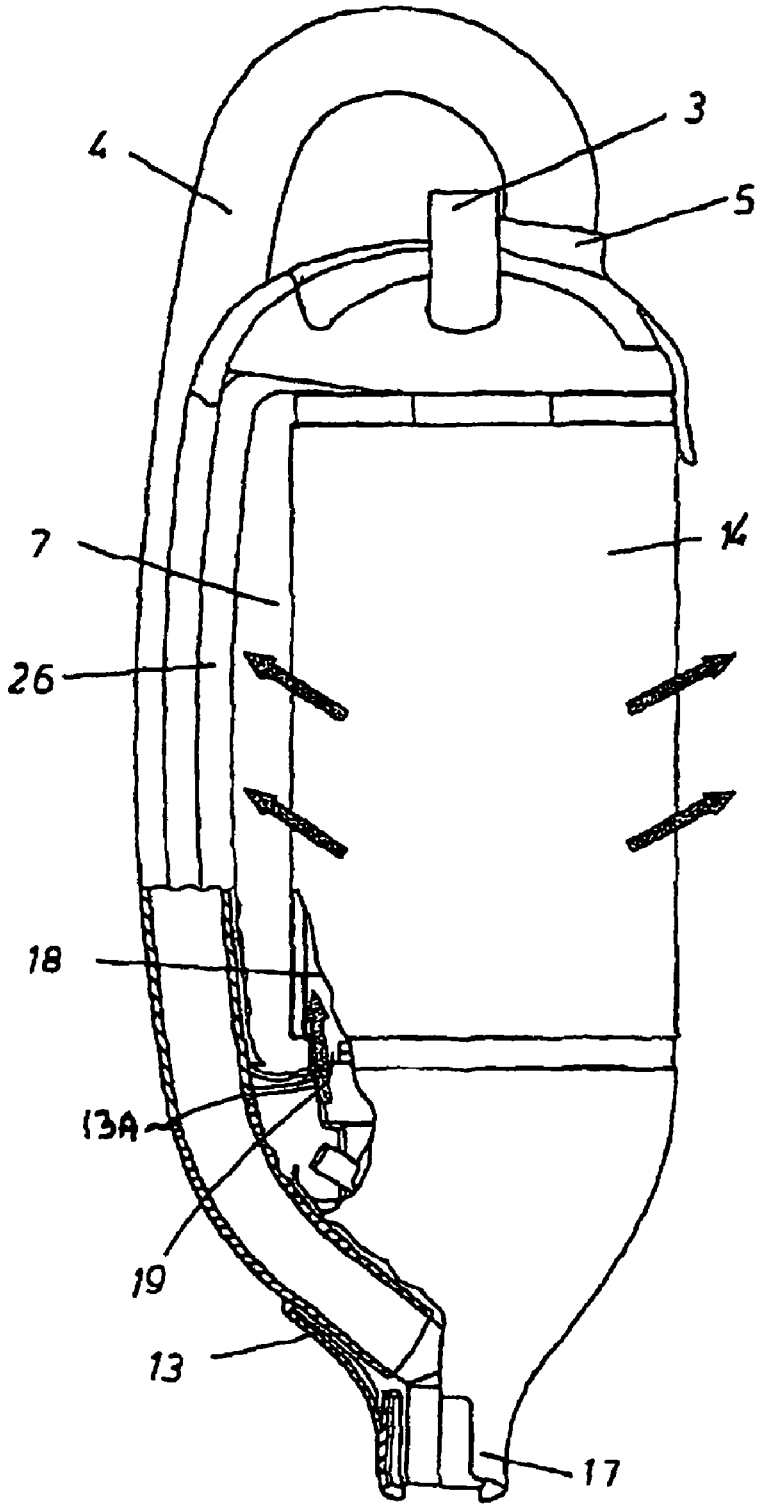
FIG. 9 is a schematic illustration of an embodiment in which the exhaust air is routed via the exhaust filter.

The embodiments shown in FIGS. 5 and 6 could possibly comprise a suction element for feeding the hose 4 back down into the tubular element 16 if it has been removed to clean other surfaces, such as shelves or ceilings. The suction element could guide the hose 4 back to the bottom area of the vacuum cleaner, and the hose could be held by or locked into the suction element, so that it can easily connect with the vacuum cleaner head for cleaning floors. This function would be used if the tubular element 16 is not removed from the body of the vacuum cleaner, but rather the hose 4 is removed from the tubular element 16. Further, as shown in FIG. 9, the receptacle opening 13 has an end 13A where the hose 4 is fed into the receptacle opening 13. In other possible embodiments, the receptacle opening 13 may be larger or smaller, shorter or longer, depending on the design of the tubular element 16 and the different uses of the hose 4.

Figure 4:
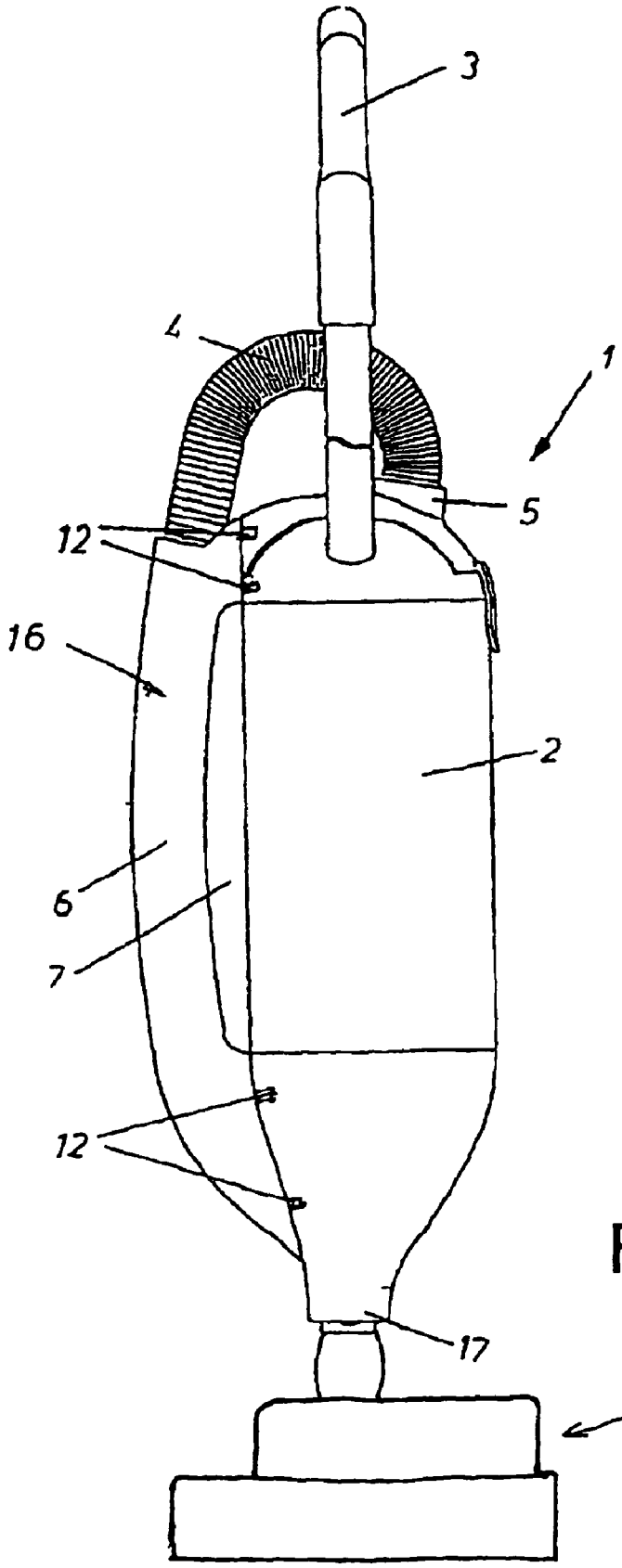
FIG. 4 shows a possible embodiment of a vacuum cleaner with a floor cleaning attachment installed thereon.

In the illustrated arrangements, the hand-held vacuum cleaner 1 comprises an approximately cylindrical vacuum cleaner body 2. In this case, a steering rod 3 is located in the form of a handle on the upper end of the vacuum cleaner body 2 and the floor cleaning attachment 101, which is generally shown only in FIG. 4, is located on the lower end of the vacuum cleaner body 2.

Figure 10:
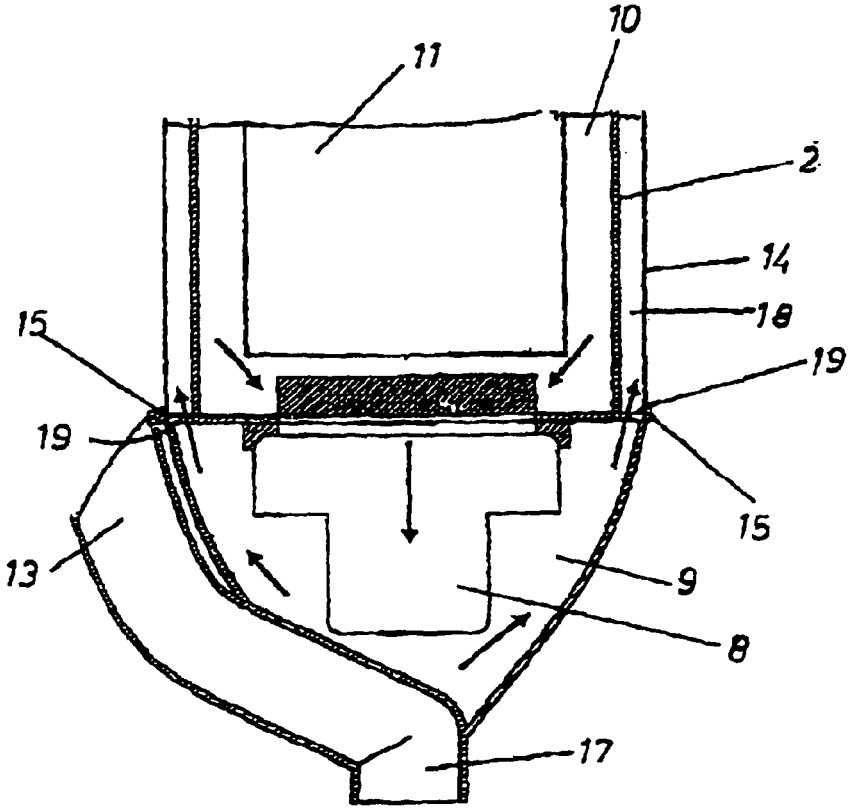
FIG. 10 is an additional illustration of an embodiment in which the air is routed via the motor compartment.

A motor 8 is located in the known manner in a motor compartment 9 that is located on the side 17 that is associated with the floor cleaning attachment and a dust collection compartment 10 with a filter bag 11 is located on the side associated with the steering rod 3, whereby the compartments are connected by means of a motor protection filter (shown in FIG. 10). An input 5 for the dust-laden air is located in the upper area, the area in which the steering rod 3 meets the housing 2.

A vacuuming hose 4 forms a connection from this input 5 to the lower end 17 of the unit, to which the floor cleaning attachment is connected. The vacuuming hose 4 is permanently connected to this input 5 and is detachably connected in the lower area.

As shown in FIGS. 5 and 6, the vacuuming hose 4 is held in a receptacle element 6 in the shape of a tubular element 16 which is detachably connected at the top and bottom to the vacuum cleaner body 2 and is elevated in a curved shape from the vacuum cleaner body 2 forming a reach-through opening 7. For vacuuming above the floor, the vacuum hose 4 can be removed from the receptacle element 6 and separated.

Figure 7:
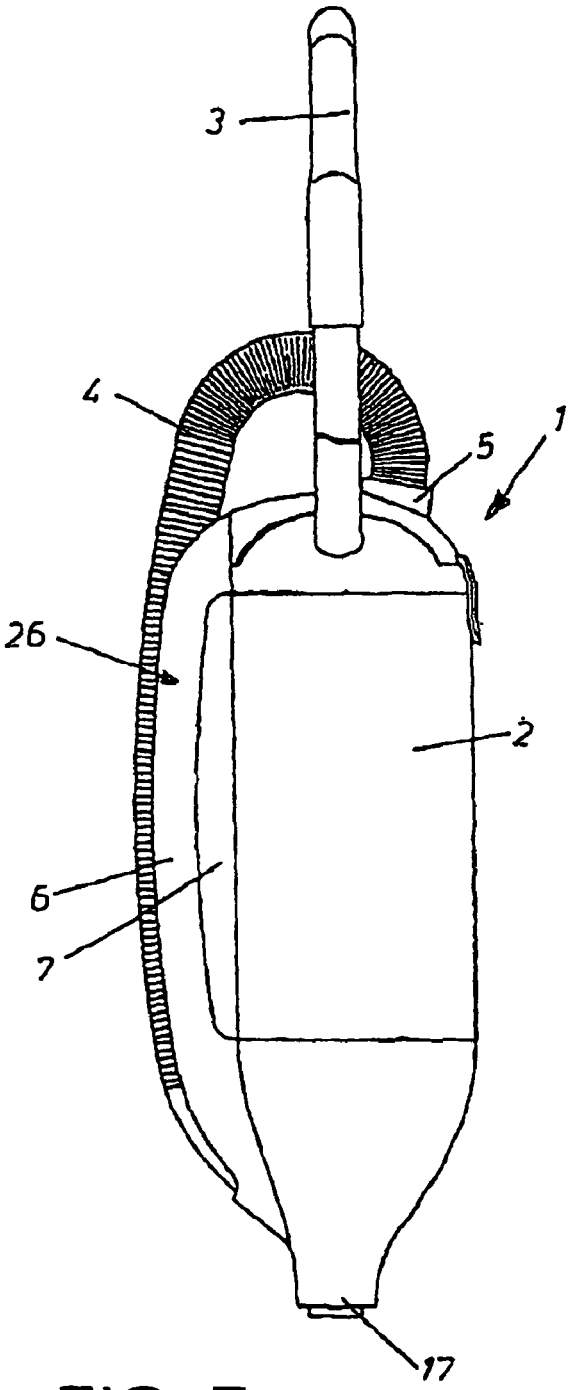
FIG. 7 shows an additional realization with a receptacle element that is realized in the form of a shell.
Figure 8:
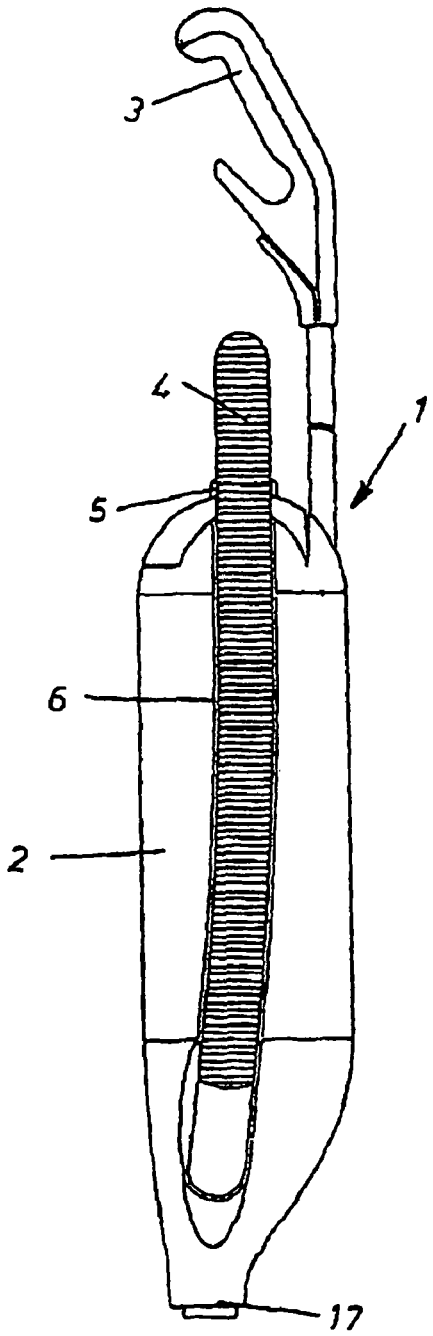
FIG. 8 is a side view of the embodiment illustrated in FIG. 7.

The receptacle element 6, as shown in FIGS. 7 and 8, is realized in the form of an open shell element 26, by means of which the hose 4 is always held so that if necessary, it can be removed from a receptacle opening 13 of the housing 2.

The tubular element 16, as shown in FIGS. 5 and 6, can optionally be removed by lockable mating connecting elements 12 and can be used as an extension of the vacuum hose 4 in the receptacle.

The housing 2 is sheathed in its cylindrical area in the manner of a hose by a filter material 14 and is detachably connected to the housing 2 by means of fastening elements 15, and is sealed with respect to the exterior. As a result, a jacket space 18 is formed between the housing 2 and the filter material 14, and is connected via passages 19 with the motor compartment 9, and the exhaust air exits via the filter material 14 over a wide area.

As discussed herein, the exhaust air exits over a wide area in order to reduce the noise produced by the use of the vacuum. As stated above, a plurality of passages 19 distributes the exhaust air flow throughout the jacket space 18. These passages 19 are designed to promote an optimum balance between reduction of noise and reduction of air flow resistance. For example, if the passages 19 are too few and/or too small, the air flow resistance would increase and performance of the vacuum would be diminished. On the other hand, if the passages 19 are too numerous and/or too large, the noise would not be reduced to a desired level. Therefore, the passages 19 are configured to simultaneously promote optimum air flow and optimum noise reduction, which results in a vacuum that cleans effectively with substantially reduced noise. It should be understood that the size and number of passages 19 could be modified to achieve various desired levels of air flow resistance and noise reduction.

As a result of the passage opening 7 that is formed between the vacuum cleaner body 2 and the receptacle element 6 in the form of a shell element 26 or tubular element 16, an operating and carrying handle is formed that can be used to operate and carry the unit, and also makes it possible to insert and attach the filter material 14 in the housing 2.

One of the problems of the prior art is the excessive noise often produced by vacuum cleaners. The present application describes an air flow system and vacuum cleaner design that greatly reduces the amount of nose produced by the vacuum cleaner. The prior art describes vacuum cleaners with a fast air flow and a small area of exhaust, which combination produces more noise from the vacuum cleaner. However, in the present application, the embodiments teach a large area of exhaust and a slower air flow. For example, the filter material and the fact that the motor is encased in a compartment further help to muffle the sound produced by the vacuum cleaner.

In addition, the air from the body of the vacuum cleaner is routed downward into the motor compartment, where it is then routed up through air passages and into the jacket space formed by the body of the vacuum and the filter material. The air then escapes outward, over a large area, through the filter material. In one possible embodiment, the air passages between the motor compartment and the jacket space are large enough to permit air to flow with minimal air flow resistance, but small enough to reduce the transmission of noise from the motor compartment. Since air is able to escape through such a large area, the air flow is slowed, thus reducing the noise produced by the vacuum cleaner.

The present application relates to a hand vacuum cleaner with an upper handle in the form of a steering handle which is an extension of a housing and a floor vacuum attachment which is located in the vicinity of the floor, whereby the dirt-laden air is transported via a hand vacuuming hose which is in the form of an ascending line into an upper portion of the housing to a dust separator unit that is located upstream of a motor, and the exhaust air is guided outward via air outlets in the housing, and the hand vacuuming hose is located in the area facing the vacuum nozzle so that it can be detached to perform auxiliary vacuuming tasks.

Hand vacuum cleaners are generally designed for use with floor attachments or nozzles. For other cleaning tasks, either other cleaning attachments are connected to the vacuum cleaner body or a hand-held vacuuming hose is used instead of the floor nozzle. Both solutions have the disadvantage that either the equipment is difficult to handle, or the process of converting the unit from one operation to another is complex and time-consuming, because the objective is to make possible a rapid change between the types of operation. In addition, it is conventional on vacuum cleaners to route the air that is sucked in, after it is passed through a dirt trap and the filter, through an exhaust conduit to a plurality of housing slots that are located next to one another. The air exits these slots in the housing at significant flow velocities. On account of the relatively high concentration of the air flow, the exhaust can be very noisy, and to some extent, some components of the noise are also transmitted from the vicinity of the motor.

For technical reasons related to fluid flow, it is desirable to make the exhaust duct and the exit point in the vicinity of the housing of the vacuum cleaner as large as possible, to thereby create a low exhaust resistance. In direct contradiction to these requirements, however, a reduction of acoustical emissions is also required, which could be achieved by a relatively high flow resistance. These contradictory requirements have not been satisfactorily resolved by the prior art.

The present application relates to a hand vacuum cleaner with an upper handle in the form of a steering rod as an extension of a housing that has an approximately cylindrical configuration and a floor vacuuming attachment, and a removable hand-held vacuuming hose in the form of an ascending line for the floor vacuuming attachment. The hand-held vacuum hose is routed via a receptacle element that is attached to the outside of the housing. For this purpose, the receptacle element is realized in the form of a tube or shell element, and is connected in its outer areas with the vacuum cleaner body, forming a reach-through opening. In addition, the cylindrical housing is sheathed in a hose-like fashion by the filter material, and the air that is to be exhausted is introduced via passages into a jacket space that is formed between the housing and filter material.

One feature or aspect of an embodiment is believed at the time of the filing of this patent application to possibly reside broadly in a hand vacuum cleaner with an upper handle in the form of a steering rod as an extension of a housing and a floor vacuum attachment that is located in the vicinity of the floor, whereby the dirt-laden air is fed via a hand vacuuming hose in the form of an ascending line into a dust separating unit that is upstream of a motor in an upper portion of the housing, and the exhaust air is transported outward via air outlets in the housing, and the hand vacuuming hose is detachably connected in the area facing the vacuum nozzle for auxiliary vacuuming tasks, characterized by the fact that the housing in the form of a vacuum cleaner body has, in its central portion, an approximately cylindrical configuration, which is sheathed by filter material that acts as an exhaust filter, and the air to be exhausted can be routed into a jacket space that is formed between the housing and the filter material, and in an area facing the motor compartment there are passages to the jacket space, and that for the hand vacuuming hose, an outboard receptacle element is provided, whereby the receptacle element is connected to the housing leaving a space between which forms a reach-through opening that can be used to transport the vacuum cleaner and to replace the filter material.

Another feature or aspect of an embodiment is believed at the time of the filing of this patent application to possibly reside broadly in a hand vacuum cleaner, characterized by the fact that the receptacle element is realized essentially in the form of a shell, in the manner of a curved receptacle.

Yet another feature or aspect of an embodiment is believed at the time of the filing of this patent application to possibly reside broadly in a hand vacuum cleaner, characterized by the fact that at least the lower portion of the receptacle element is realized in a tubular shape.

Still another feature or aspect of an embodiment is believed at the time of the filing of this patent application to possibly reside broadly in a hand vacuum cleaner, characterized by the fact that the receptacle element is realized in the form of a tube in the manner of a curved receptacle and is detachable so that it can be used as a removable hand-held vacuuming element.

A further feature or aspect of an embodiment is believed at the time of the filing of this patent application to possibly reside broadly in a hand vacuum cleaner, characterized by the fact that the receptacle element is detachably connected with the vacuum cleaner body by means of lockable mating connecting elements in the connecting areas.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The corresponding foreign patent application, namely, Federal Republic of Germany Patent Application No. 10 2004 007 031.8, filed on Feb. 6, 2004, having inventors Thomas STEIN and Achim LIFFERS, and DE-OS 10 2004 007 031.8 and DE-PS 10 2004 007 031.8, is hereby incorporated by reference as if set forth in their entirety herein for the purpose of correcting and explaining any possible misinterpretations of the English translation thereof. In addition, the published equivalents of the above corresponding foreign and patent application, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The following patents or patent applications are incorporated by reference as if set forth in their entirety herein: U.S. Design Pat. No. D575,916, issued on Aug. 26, 2008, entitled "VACUUM CLEANER," and having inventor Thomas STEIN and attorney docket no. NHL-DH-113-DES; and European Design Patent Application No. 000303516, filed Mar. 1, 2005.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of cleaning dirt and debris from surfaces using a cleaning device, said cleaning device comprising:

a body portion comprising:

a first end portion comprising a first lockable mating connecting element;

a second end portion comprising a second lockable mating connecting element;

a filter compartment being disposed between said first end portion and said second end portion;

a motor being configured to generate a suction;

said second end portion configured to receive a floor cleaning attachment;

a steering rod being connected to said first end portion;

a handle unit comprising a first handle end, a second handle end, and an elongated handle portion;

said first handle end being lockably connected to said first lockable mating connecting element, and said second handle end being lockably connected to said second lockable mating connecting element, to lockably connect said handle unit to said body portion to permit carrying of the entire cleaning device by a user solely by grasping said elongated handle portion of said handle unit;

a hose configured and disposed to connect said first end portion of said body portion to said handle unit to permit flow of air from said handle unit to said first end portion of said body portion;

said handle ends detachable from said lockable mating connecting elements to permit a user to remove dirt and debris from a surface through said handle unit;

said handle ends, upon said handle unit being attached to said body portion, being configured to project away from said end portions of said body portion, such that a space is formed between and defined by said handle ends, said elongated handle portion, and said filter compartment, which space is sufficient to permit insertion of a hand of a user between said elongated handle portion and said filter compartment; and said method comprising:

detaching said handle ends from said lockable mating connecting elements and thus from said end portions of said cleaning device;

activating said motor and generating a suction;

removing dirt or debris from a surface by conducting dirt or debris through an opening in said second handle end, then conducting the air with said dirt and debris through said elongated handle portion, then through said first handle end, then through said first end portion of said body portion, and then into said filter compartment;

reattaching said handle ends to said lockable mating connecting elements and thus to said end portions of said cleaning device; and grasping solely said elongated handle portion by inserting a hand of a user through said space between said handle unit and said filter compartment, and then lifting and carrying said cleaning device solely by said handle unit.

2. The method of cleaning dirt and debris from surfaces according to claim 1, wherein:

said method further comprises passing a sheath of filter material through said space between said longated handle portion and said filter compartment, and then wrapping said filter material around an exterior of said filter compartment.

3. The method of cleaning dirt and debris from surfaces according to claim 1, wherein:

said motor is disposed in a motor compartment;

said filter compartment includes a filter bag therein;

said motor is configured to conduct air through said filter compartment and then through said motor compartment; and said method further comprises:

(i) trapping said dirt and debris using said filter bag; and (ii) conducting air laden with any dirt and debris not trapped in step (i) into said motor compartment.

4. The method of cleaning dirt and debris from surfaces according to claim 2, wherein:

said cleaning device comprises fastening elements configured to connect said sheath of filter material to said filter compartment.

5. The method of cleaning dirt and debris from surfaces according to claim 3, wherein:

said cleaning device comprises a sheath of filter material wrapped around an exterior surface of said filter compartment;

a plurality of openings configured and disposed to permit flow of air from said motor compartment into a space surrounding said filter compartment between said sheath of filter material and the exterior surface of said filter compartment; and said method further comprises:

(iii) conducting air laden with any dirt and debris not trapped in step (i) from said motor compartment, through said plurality of passages, and into said space; and (iv) trapping any dirt and debris not trapped in step (i) using said sheath of filter material.

6. The method of cleaning dirt and debris from surfaces according to claim 4, wherein said method further comprises:

(a) trapping said dirt and debris using a filter bag in said filter compartment; and (b) trapping any dirt and debris not trapped in step (a) using said sheath of filter material.

* * * * *